United States Patent [19]

Holowaty

[11] Patent Number: 4,786,466

[45] Date of Patent: Nov. 22, 1988

[54] LOW-SULFUR, LEAD-FREE FREE MACHINING STEEL ALLOY

[75] Inventor: Michael O. Holowaty, Crown Point, Ind.

[73] Assignee: Frema, Inc., Crown Point, Ind.

[21] Appl. No.: 16,624

[22] Filed: Feb. 19, 1987

[51] Int. Cl.[4] ..... C22C 38/60

[52] U.S. Cl. ..... 420/84; 420/87

[58] Field of Search ..... 420/84, 87

[56] References Cited

U.S. PATENT DOCUMENTS

| | | | |
|---|---|---|---|
| 2,009,714 | 7/1935 | Palmer | 420/84 |
| 2,182,758 | 12/1939 | Harder | 420/84 |
| 3,152,889 | 10/1964 | Holowaty | 420/84 |
| 3,152,890 | 10/1964 | Holowaty | 420/84 |
| 3,853,544 | 12/1974 | Nishi et al. | 420/84 |
| 3,933,480 | 1/1976 | Tipnis | 420/41 |
| 4,236,939 | 12/1980 | Bhattacharya et al. | 148/2 |
| 4,244,737 | 1/1981 | Holowaty et al. | 75/129 |
| 4,247,326 | 1/1981 | Quinto et al. | 420/84 |
| 4,255,187 | 3/1981 | Bhattacharya et al. | 420/84 |
| 4,255,188 | 3/1981 | Riekels | 420/84 |
| 4,333,776 | 6/1982 | Bhattacharya et al. | 420/84 |
| 4,389,249 | 6/1983 | Holowaty et al. | 75/129 |
| 4,444,588 | 4/1984 | Ney | 420/45 |
| 4,524,819 | 6/1985 | Yoshimura | 164/468 |

FOREIGN PATENT DOCUMENTS

| | | | |
|---|---|---|---|
| 49-86610 | 2/1974 | Japan | 420/84 |

*Primary Examiner*—Deborah Yee

*Attorney, Agent, or Firm*—Trexler, Bushnell, Giangiorgi & Blackstone, Ltd.

[57] ABSTRACT

Composition and continuous casting method for producing a low-sulphur, free-machining steel, substantially free of lead and including in weight percent about 0.05–0.40 copper, 0.005–0.040 tellurium, 0.002–0.15 bismuth, 0.002–0.05 tin, up to 0.55 carbon, and less than 0.25 sulphur, traces (up to about 0.005 weight percent) of barium, and the balance being iron. The elements bismuth, tellurium and tin are added as a molten alloy to the molten steel and uniformly distributed therethrough. The elements copper and barium can be added separately into the steel stream ahead of the molten addition inflow. The mass is then cooled to provide a solid metal casting substantially free of blemishes and relatively free of surface checking and tearing. The casting is characterized by enhanced machining properties.

13 Claims, 1 Drawing Sheet

LOW-SULFUR, LEAD-FREE FREE MACHINING STEEL ALLOY

BACKGROUND OF THE INVENTION

The present invention relates to compositions of free-machining steels characterized by low sulfur concentrations and being essentially free of lead. More particularly, the invention is directed to products in which sulfur, bismuth and various combinations of copper, tellurium, tin and barium are added to and distributed through the molten steel. The resulting composite is then cooled to provide a solid metal ingot, bloom or billet convertible to a finished product having free-machining properties. Included in the present invention are methods and apparatus for producing the free-machining products in a continuous process.

Numerous formulations of free-machining steels are described in the relevant literature. Such formulations usually include low melting elements added to improve machining characteristics. Sulphur is the most commonly used additive incorporated in free-machining steels. In many of the prior art formulations, the concentration of sulfur is 0.30% or greater. High concentrations of sulfur are undesirable in that they cause defects and excessive discontinuities on the surface of the cast product and on the hot worked product due to hot shortness or tearing.

Lead is the second most commonly used additive incorporated in free-machining steels. Lead has two serious disadvantages:

- Lead oxides are hazardous. Extreme caution must be taken during steelmaking, and any other processing steps involving high temperatures. Such process steps produce lead and/or lead oxide fumes. Atmosphere control procedures must be incorporated in high temperature processing of lead bearing steels.
- Lead is not uniformly distributed throughout the conventional steel products; it is not significantly soluble in the steel and, due to its high density, settles during the teeming and solidification process, resulting in segregation or non-uniform distribution within the as-cast and final product.

It is a principal aim of the present invention to reduce the above and other objectionable features due to high sulfur and to the presence of lead, and to realize at the same time product improvements to ensure optimum machining properties in the steel produced.

BRIEF SUMMARY OF THE INVENTION

It is a principal object of the present invention to eliminate lead in free-machining steel, thereby obviating both the adverse effects of lead in the formulations themselves as well as preventing the contamination of the ambient system by lead compounds and the exposure of workers to the hazardous lead fumes.

A related object of the invention is to provide a novel combination of alloying elements for incorporation in steel to attain optimum machining properties of the steel. It is a feature of the present invention that it eliminates the objectionable lead without adversely affecting the desirable properties of the steel.

Another important object of the invention is to reduce the concentration of sulfur to minimize checking, tearing and cracking in the casting and during subsequent hot working.

An additional important property of the free-machining steels of the invention is that they may be cast continuously to produce billets or blooms; alternatively, they may be cast into ingots. The steels of the present invention are characterized by a remarkably high degree of chemical and metallographic uniformity.

An important feature of the invention is the substitution of bismuth for lead as a machining lubricant and, when required, the use of tellurium as a lubricant promoter. Yet another feature of the present invention is that controlled concentrations of copper are present in the liquid steel.

In a preferred method of the invention molten bismuth is introduced into the molten steel as the latter is released from the tundish to flow into the casting mold.

Preferred compositions of the invention are characterized by the inclusion of tin in small quantities as a stabilizer of grain structure.

In a preferred method of formulating the compositions of the invention, the bismuth, tellurium, and tin in various combinations are melted together and then added as a liquid to liquid steel at substantially the stage in the process when the steel flows into the casting mold. Also, barium, in small concentrations, may be added directly to the molten steel.

Copper, in the form of wire or continuous rod, is added, as required, as an embrittling agent, to the liquid steel ahead of the inflow of the liquid bismuth or bismuth alloy. Addition may be made directly into the molten steel, in the ladle, in a tundish, or to the steel stream flowing into the mold.

In a preferred embodiment of the invention, barium is added, in the form of a clad or encapsulated solid product, as an oxide stabilizer addition to the liquid steel prior to the casting step.

It is an important feature of the steels produced in accordance with the present invention that the alloy components are effectively distributed uniformly throughout the molten mass. A result is that the final solid steel product is more homogeneous than are products produced by other methods.

In a specific preferred embodiment of the method of the invention, uniformity in the final product is ensured by introducing the critical alloying elements in a liquid form, these being added to the liquid steel during the continuous casting process.

It is a related feature of the method of the invention that formation of objectionable solidification nuclei is eliminated by avoiding the introduction of alloying elements in the form of particulate solids.

Yet another important advantage of the present invention is the reduction of the sulfur level in order to minimize the corner cracking and hot rupturing frequently experienced in continuous casting or in rolling of such conventional AISI-grades as: 1214, 12L14, 1215, 12L15 and 1144 free-machining steels.

In accordance with the practice of the present invention, a low melting alloy of bismuth, and/or tin, and/or tellurium is conducted from a heated container through a volume controlling nozzle assembly, into the molten steel stream.

As a second technique for adding the alloying agents, liquid bismuth or an alloy of bismuth, and/or tin, and/or tellurium in various concentrational ratios, in the molten state, is poured through an intermediate container to provide a constant head pressure into a volume-controlling nozzle assembly.

Another feature of the invention is that the addition of copper, if required, is made either to liquid steel or in solid forms, for example a rod or wire. Barium may also be added as a solid to the molten steel, the copper and the barium being introduced prior to adding the bismuth or bismuth alloy.

Other features, objects and advantages of the invention will become evident from a consideration of the drawing and of the following detailed description of preferred embodiments.

DETAILED DESCRIPTION OF PREFERRED EMBODIMENTS

In accordance with the present invention, the aims and objects are achieved by providing compositions and a continuous casting method for producing a low-sulfur, free-machining steel substantially free of lead and in which the sulfur concentration is reduced and substituted in part by copper, barium, and/or tin.

Overall concentrational ranges for elements present in the final castings of the invention are indicated in Table 1. Consistent with Table 1, no chromium or nickel need be employed in the steel. Additional data characterizing the low-sulfur, lead-free, free-machining steel of the invention are presented in Table 3. In a preferred embodiment of the invention, the combined concentration of copper, nickel and tin is such as to exceed the concentration of bismuth in the final cast product. The carbon concentration is preferably less than 0.55 weight percent in the final steel product, and the sulfur concentration is preferably below 0.06 weight percent while the ratio of Cu/Cr+Ni+Sn is greater than one (Table 2).

TABLE 1

| Element | (In Weight Percent) Conc. Range | |
|---|---|---|
| C | 0.05–0.55 | |
| Mn | 0.30–1.20 | |
| P | 0.02–.15 | |
| S | 0.02–0.20 | |
| Cu | 0.05–0.40 | |
| Bi | 0.002–0.15 | |
| Sn | 0.002–0.05 | |
| Si | 0–0.35 | |
| Te | 0.005–0.040 | |
| Cr | 0–0.080 | total to 0.20 Max |
| Ni | 0–0.080 | |
| Mo | 0–0.080 | |
| Al | 0–0.004 | |
| Cb | 0–0.04 | total 0.060 Max. |
| V | 0–0.06 | |
| Ba | 0–0.005 | |

In the formulations of the free-machining steels of the invention, particular ratios of the major specific elements are preferred. Specifically, the ratio of copper to bismuth is preferably from 1:1 to 15:1; the ratio of bismuth to tin is from 1:1 to 10:1 and the ratio of copper to bismuth plus tin is from 1:1 to 15:1. The phosphorus content is preferably 0.02 to 0.09 weight percent.

The general ratios of various elements are set forth in Table 2.

TABLE 2

| Element | Ratios of Elements Range |
|---|---|
| Cu/Bi | 1:1–200:1 |
| Bi/Sn | 1:1–50:1 |
| Bi/Te | 1:1–20:1 |
| Cu/Te | 1:1–80:1 |
| Cu/Bi + Sn | 1:1–100:1 |
| Cu/S | 1:1–20:1 |
| Mn/S | 3:1–60:1 |
| Cu/Ni + Cr + Sn | 1:1–4:1 |

There are several current, commercial methods available to cast ingots and billet or bloom sections whereby the free-machining steels of the invention may be produced. Included in the apparatus used are both vertical and horizontal continuous casters. A typical layout of the latter type of equipment is indicated schematically in FIG. 1.

Figure 1:
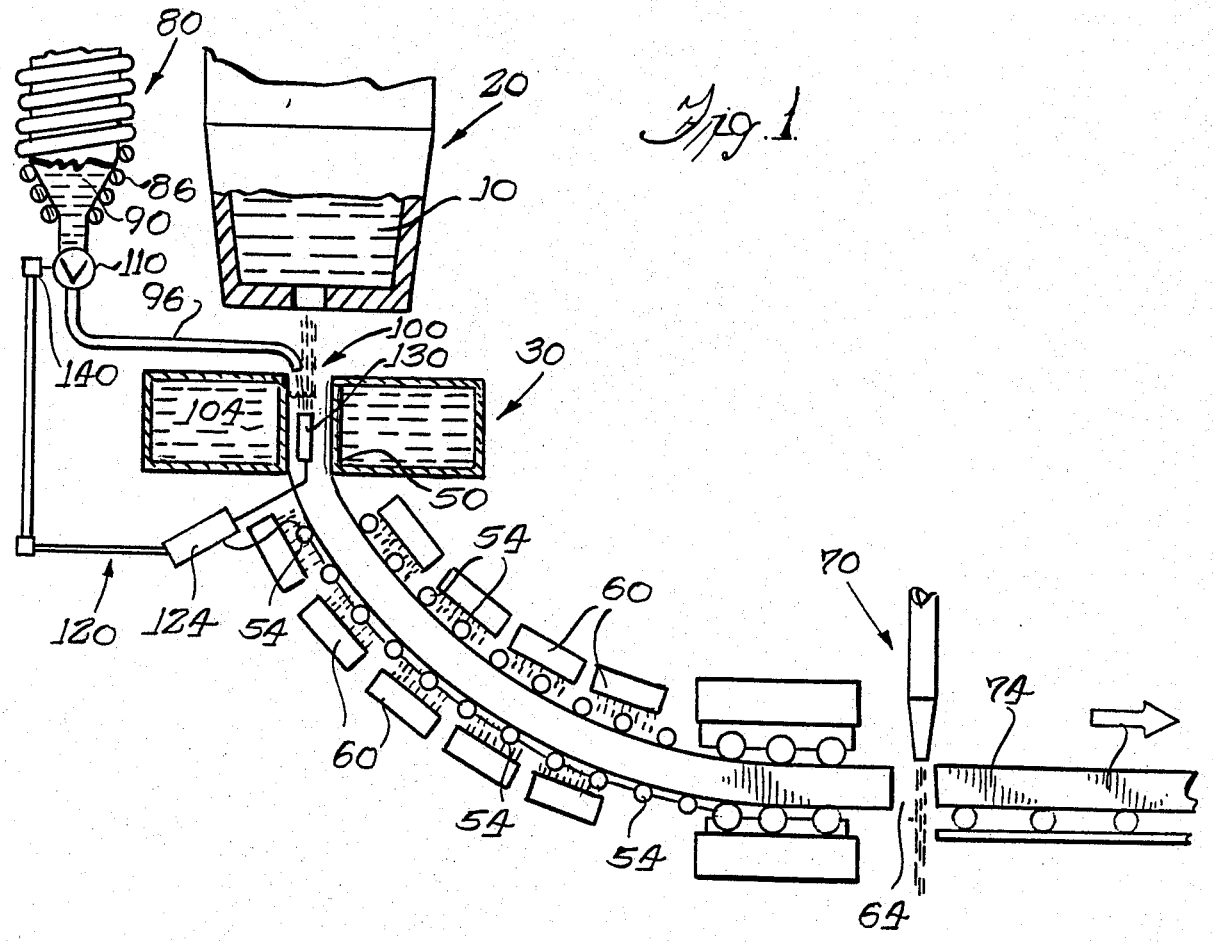
FIG. 1 is a schematic representation of a continuous casting apparatus for producing the lead-free, low-sulfur, free-machining products of the invention.

As depicted schematically in FIG. 1, molten steel 10 in a tundish 20 is delivered to a mold 30 at a reasonably controlled rate. Each transfer of molten steel is protected from air contamination by suitable means such as refractory tubes or inert gasses.

The cast steel 50 is continuously pulled from the mold 30 by shaping, guiding and driving rollers 54 through water spray coolers 60 to form a billet or bloom 64 having a desired cross-sectional configuration.

When the billet or bloom 64 has reached a desired length it is cut off by a suitable shear, saw or cutting torch 70 to provide a casting 74 of the length desired for further processing.

In one method of the invention, the molten steel 10 is discharged from a tundish 20 into a water-cooled mold 30 while a melting and metering feed vessel 80 fitted with a heating coil 86 and containing a quantity of alloying elements in specific selected ratios is positioned to deliver the alloy 90 through a conduit 96 for blending into the molten steel 10. The alloy 90 is delivered into the molten steel stream at its entry 100 into or just above the pool of metal 104 contained in the water-cooled mold 30 to provide, through agitation therein, a homogeneous cast product 50.

A metering valve 110 below the molten alloy 90 in the feed vessel 80 is electrically coupled 120 to a drive mechanism 124 of the shaping, guiding and driving rollers 54. These rollers 54 control the withdrawal rate of the steel 50 from the water-cooled mold 30. As indicated schematically in FIG. 1, the pinch roller 54 drive mechanism 124 is controlled in accordance with feedback from a detector 130, of known construction, which measures the level of the liquid steel 104 in the water-cooled mold 30. An electrical signal to the drive mechanism 124 is coupled to a feed valve controlling motor 140 which adjusts the metering valve 110 so that the flow of molten alloy 90 through the metering valve 110 is in a predetermined proportion to the rate of withdrawal of the steel 50 from the water-cooled mold 30.

Figure 2:
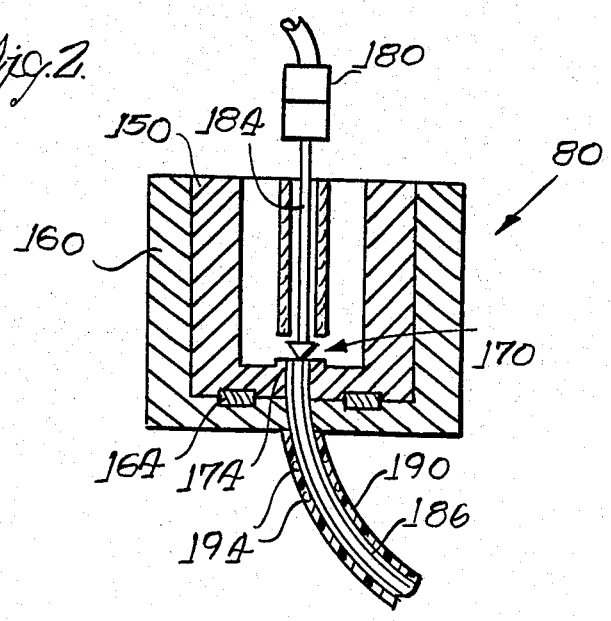
FIG. 2 is a simplified, schematic representation, partial in section, and showing apparatus for delivering liquid alloying materials to a steel melt.

FIG. 2 illustrates one suitable form of the alloy feed vessel 80, in greater detail. The vessel 80 includes a receptacle 150 surrounded by an insulating jacket 160 and heated by an electrical element 164. A valve element 170 controls the flow of fluid alloy through the valve seat 174. A motor and valve drive unit 180 is connected by a rod 184 to the valve element 170. An alloy delivery or discharge pipe 186 is surrounded by an insulating jacket 190 and is heated by electrical coils 194.

While the method described is a process for continuous vertical casting with a curved mold and guidance path for the billet, the products of the invention may also be made using a completely vertical or a completely horizontal continuous casting technique or an ingot practice.

For purposes of disclosure, there has been shown, as one embodiment of the invention, the use of an alloy feed vessel 80. Within the concept of the present invention is an embodiment of the invention in which a metering pump of known construction (not shown) is used to transfer the molten alloy to the continuous stream of molten steel. In yet another arrangement, molten alloy is poured from a melting vessel into a separate tundish, providing a controllable molten alloy head pressure to an orifice nozzle or nozzles.

In the low-sulfur, lead-free, free-machining steel of the present invention, the metal delivered from the feed vessel 80 is principally molten bismuth, introduced in an amount to provide up to 0.15 weight percent in the casting produced. In preferred embodiments of the formulations, tin and tellurium in small concentrations, to provide from 0.002–0.05 weight percent tin and from 0.005–0.040 weight precent tellurium in the final cast product, may be incorporated with the bismuth to provide a liquid addition alloy.

The copper concentration in the steel is adjusted, as required, by rateably feeding solid copper wire or rod into the continuous liquid stream at a position ahead of the inflow of liquid bismuth or bismuth alloy, so that the final concentration of copper in the cast product is in the range of 0.05–0.40 weight percent.

Sulfur concentration is intentionally kept low, in accordance with the principles of the invention. The concentration is below 0.25 weight percent, and preferably in the range of 0.02–0.06 weight percent.

The methods of the invention are particularly applicable for use in the continuous casting of billets and blooms in sizes 5"×5" and larger.

It is a feature of the present invention that the alloy additions are made in accordance with a technique to ensure absence of solidification nuclei in the cast structure. Such solidification nuclei are believed to be caused by the injection of low melting alloying elements in the form of solid shot or other solid particulate forms.

The marked reduction of sulfur concentration, in accordance with the present invention, has the beneficial effect of reducing corner cracking and hot rupturing normally experienced in continuous casting and rolling or in the rolling of ingot cast steels of conventional AISI-graded or similar free-machining steel.

It is believed that the nature of the present invention will be understood from the foregoing description. Additional compositional details pertaining to compositions within the scope of the invention are set forth in the following examples (Table 3) showing specific preferred formulations.

TABLE 3

| | CONCENTRATIONS ARE IN PERCENT BY WEIGHT | | | | | | | | | |
|---|---|---|---|---|---|---|---|---|---|---|
| | C | Mn | P | S | Si | Bi* | Sn | Cu** | Te | Ba |
| #1 | .15 Max. | .60–90 | .04–.09 | .15 Max. | up to 0.02 | .05–.25 | .002–.015 | .15–.40 | — | — |
| #2 | .09 Max. | .06–.90 | .04–.09 | .15 Max. | up to 0.02 | up to 0.35 | .002–.015 | .15–.40 | .040 Max. | — |
| #3 | .15–.20 | .60–.90 | .400 Max. | .15 Max. | up to 0.10 | up to .20 | .002–.015 | to 0.20 | — | — |
| #4 | .43–.50 | .60–.90 | .040 Max. | .10–.20 | .15–.35 | up to .20 | .002–.015 | .15–.40 | — | .005 Max. |
| #4A | .43–.50 | .60–.90 | .040 Max. | .10–.20 | .10 Max. | up to .20 | .002–.015 | .15–.40 | .040 Max. | .005 Max. |
| #5 | .15 Max. | .60–.90 | .04–.09 | .20 Max. | to 0.02 | up to .20 | .002–.015 | .15–.40 | .040 Max. | — |
| #6 | 48–.55 | .60–.90 | .040 Max. | .15 Max. Preferably less than 0.1 | .15–.35 | .05–.15 Preferably less than 0.15 | .002–.015 Preferably less than 0.01 | .25 Max. Generally, at least 0.25 | | .005 Max. |

*lower concentrations are ordinarily preferred
**concentrations in range of 0.25 to 0.35 are preferred The higher concentrations of bismuth enhance the machinability but add to overall cost as well as reducing the yield.

Barium functions as a deoxidizer and as an oxide stabilizer. The relatively soft barium oxide which forms enhances the grain structure.

As set forth above, in accordance with the present invention, there are provided compositions and methods for producing a low-sulfur, free-machining steel substantially free of lead and in which many of the shortcomings and inadequacies of prior art formulations and techniques have been greatly reduced. The compositions of the invention avoid objectionable pollution effects and enhance the safety of the manufacturing procedures. Avoidance of contamination of atmosphere by lead fumes is achieved and, at the same time, the final lead free-steel metal products exhibit markedly superior free-machining properties.

What is claimed is:

1. A low-sulfur, free-machining steel substantially free of lead and consisting essentially of, in percent by weight Sulfur : 0.02–0.06
Copper : 0.05–0.40
Bismuth : 0.002–0.15
Nickel : less than about 0.08
Chromium : less than about 0.08
Tin : 0.002–0.05 and the balance consisting essentially of iron, and in which the combined concentration of copper, nickel, chromium and tin exceeds the concentration of bismuth.

2. A composition as set forth in claim 1 and further comprising tellurium in a concentration of from 0.005 to 0.040 percent by weight, as a lubricant promoter operable during machining operations.

3. A composition as set forth in claim 1 and further comprising less than about 0.005 percent by weight of barium.

4. A composition as set forth in claim 1 and further comprising less than about 0.005 percent by weight of barium, and tellurium in a concentration of from 0.005 to 0.040 percent by weight.

5. A composition as set forth in claim 1 and further comprising carbon in a concentration of up to about 0.55 percent by weight.

6. A free-machining steel as set forth in claim 5 wherein the carbon content is less than 0.20 weight percent.

7. A free-machining steel as set forth in claim 1 wherein the copper concentration is about 0.2 weight percent.

8. A free-machining steel as set forth in claim 1 wherein the bismuth concentration is 0.002–0.15 weight percent.

9. A free-machining steel as set forth in claim 1 and further comprising tellurium in a concentration of from 0.005 to 0.040 percent by weight, and wherein the elemental ratios of copper, tin, tellurium and sulfur are as follows:

| Element | Range |
|---|---|
| Cu/Bi | 1:1–200:1 |
| Bi/Sn | 1:1–50:1 |

-continued

| Element | Range |
|---|---|
| Bi/Te | 1:1–20:1 |
| Cu/Te | 1:1–80:1 |
| Cu/Bi + Sn | 1:1–100:1 |
| Cu/S | 1:1–20:1 |

10. The steel as set forth in claim 9 wherein a ratio of copper to the sum of chromium, nickel and tin is in the range of 1:1 to 4:1.

11. The compositional ratio as set forth in claim 8 and further comprising manganese present in a concentrational ratio with sulfur in the range of 3:1 to 60:1.

12. The steel as set forth in claim 1, and further comprising carbon in a concentration of less than 0.15 weight percent.

13. A steel casting consisting of a composition as defined in claim 1.

* * * * *